US007354177B2

(12) United States Patent
Wilcox et al.

(10) Patent No.: US 7,354,177 B2
(45) Date of Patent: Apr. 8, 2008

(54) LIGHT FIXTURE WITH COMPOSITE REFLECTOR SYSTEM

(75) Inventors: Kurt S. Wilcox, Libertyville, IL (US); Eric J. Haugaard, Kenosha, WI (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 11/505,077

(22) Filed: Aug. 16, 2006

(65) Prior Publication Data

US 2008/0043467 A1 Feb. 21, 2008

(51) Int. Cl.
*F21V 7/00* (2006.01)

(52) U.S. Cl. ..... 362/297; 362/346

(58) Field of Classification Search ..... 362/297, 362/298, 346

See application file for complete search history.

(56) References Cited

U.S. PATENT DOCUMENTS

| | | | | |
|---|---|---|---|---|
| 149,778 | A | 4/1874 | Murch | |
| 851,627 | A | 4/1907 | Norton | |
| 927,011 | A | 7/1909 | Spencer et al. | |
| 1,126,958 | A | 2/1915 | Crownfield | |
| 1,256,522 | A | 2/1918 | Croxton | |
| 1,509,744 | A * | 9/1924 | Wilson | 362/347 |
| 1,550,367 | A | 8/1925 | Kimball | |
| 1,804,651 | A | 5/1931 | Shipman | |
| 2,513,961 | A | 7/1950 | Ostrom | |
| 2,586,583 | A | 2/1952 | Wagner | |
| 3,358,133 | A | 12/1967 | Thoman et al. | |
| 3,427,447 | A | 2/1969 | Clark | |
| 3,745,326 | A | 7/1973 | Hernandez | |
| 3,755,665 | A | 8/1973 | Grindle | |
| 3,919,542 | A | 11/1975 | Castic | |
| 3,997,778 | A | 12/1976 | Fieldstad, Jr. et al. | |
| 4,066,887 | A | 1/1978 | Levis | |
| 4,220,986 | A | 9/1980 | Matteo et al. | |
| 4,379,322 | A | 4/1983 | Kelly | |
| 4,470,103 | A | 9/1984 | Krieg | |
| 4,488,205 | A | 12/1984 | Quiogue | |
| 4,519,019 | A | 5/1985 | Hall | |
| 4,538,217 | A | 8/1985 | Ewing et al. | |
| 4,709,312 | A | 11/1987 | Heinisch et al. | |
| D300,669 | S | 4/1989 | Russello et al. | |
| 5,003,449 | A | 3/1991 | Stephenson et al. | |
| 5,032,959 | A | 7/1991 | Brass | |
| 5,047,908 | A | 9/1991 | Dixon et al. | |
| 5,081,569 | A | 1/1992 | Quiogue et al. | |
| 5,115,384 | A | 5/1992 | Loth et al. | |
| 5,287,259 | A | 2/1994 | Lautzenheiser | |
| 5,406,343 | A | 4/1995 | Stephenson | |
| 5,586,015 | A * | 12/1996 | Baldwin et al. | 362/263 |

(Continued)

*Primary Examiner*—Thomas M. Sember
*Assistant Examiner*—Julie A. Shallenberger
(74) *Attorney, Agent, or Firm*—Jansson Shupe & Munger Ltd.

(57) ABSTRACT

A light fixture having first and second housing members movable between closed-fixture and open-fixture positions for lamp-changing purposes, in which a first reflector member is secured to the first housing member and includes a first connection-edge, a separate second reflector member is separately secured to the second housing member and includes a second connection-edge abutting the first connection-edge when the housing members are in closed-fixture position, and a lamp-opening is between the first and second connection-edges, such that, when the housing members are in closed-fixture position, the reflector members together form a composite reflector in the fixture housing.

12 Claims, 6 Drawing Sheets

U.S. PATENT DOCUMENTS 5,707,142 A 1/1998 Gordin
5,800,048 A 9/1998 Gordin
5,941,632 A 8/1999 Wedell et al.
5,964,522 A * 10/1999 Schaefer et al. ..... 362/350
6,059,427 A 5/2000 Wedell et al.
6,161,946 A 12/2000 Bishop et al.
D437,443 S 2/2001 Lin
6,206,551 B1 3/2001 Stubblefield, Jr.
6,244,731 B1 6/2001 Koiko et al.
6,322,235 B1 11/2001 Strobel
6,338,564 B1 1/2002 Jordan et al.
6,419,378 B1 7/2002 Wedell et al.
6,422,709 B1 * 7/2002 Panagiotou ..... 362/16
6,575,603 B2 6/2003 Stahl et al.
6,582,101 B2 6/2003 Sara et al.
6,652,113 B2 11/2003 Tant
6,793,375 B2 9/2004 Anderson
D502,283 S 2/2005 Haugaard et al.
6,905,222 B1 6/2005 Russello et al.
6,964,506 B2 11/2005 Sara et al.

* cited by examiner

LIGHT FIXTURE WITH COMPOSITE REFLECTOR SYSTEM

FIELD OF THE INVENTION

This invention is related generally to light fixtures and, more particularly, to light fixtures having a housing formed by separate housing members.

BACKGROUND OF THE INVENTION

In light fixtures, it is important that reflector(s) and lamp positioning provide desired lighting distribution and efficiency. It is also desirable to have ready access into the interior of the fixture for lamp changing or other maintenance purposes. Often, because of the positioning of reflector(s) and lamp(s), the only access to the interior of the fixture is through a lens opening.

Furthermore, because ballast compartments are often located in hard-to-reach portions of the fixture, access to the ballast and other electrical components may require substantial disassembling of the housing and reflector removal. In some light fixtures, it is necessary to partially remove the ballast, lamp socket or other electrical components for service purposes, and lengthy wiring may be used to allow such partial removal. In light fixtures intended for positioning at considerable height, this presents particularly great difficulties for installation, lamp replacement and fixture maintenance.

Some light fixtures provide partial access to a ballast compartment that is separated from the lamp socket by a reflector or an interior wall of the fixture. The complications associated with performing routine maintenance can include a risk of damaging the housing or altering a reflector configuration which in turn may lead to changes in optical characteristics and overall appearance, and may shorten the life of the light fixture.

While a vast array of light fixture arrangements have been developed, a need exists for an improved light fixture, particularly a wall-mounted light fixture, adapted for easy installation and maintenance. Such a light fixture should be configured for convenient performance of routine maintenance such as lamp changing, and also allowing easy access for service of the ballast and other electrical components without removing them, except when replacement is necessary. It would be further desirable to have a light fixture configured for easy and complete barrier-less exposure of all electrical connections in the fixture interior.

OBJECTS OF THE INVENTION

It is an object of the invention to provide an improved light fixture overcoming some of the problems and shortcomings of the prior art, including those referred to above.

Another object of the invention is to provide a light fixture adapted for easy installation and maintenance.

Another object of the invention is to provide a light fixture with a housing configured for easy and convenient performance of routine maintenance such as lamp changing operation.

Still another object of the invention is to provide a light fixture with a configuration allowing easy access to the ballast and other electrical components without a need to disassemble the housing, remove the reflector, or even remove the ballast or other electrical components.

Yet another object of the invention is to provide a light fixture configured for easy and complete barrier-free exposure of all electrical connections in the fixture interior.

How these and other objects are accomplished will become apparent from the following descriptions and the drawings.

SUMMARY OF THE INVENTION

The present invention provides an improved light fixture designed for easy installation and maintenance to optimize the fixture life while providing improved optical characteristics. This invention, which will be described in detail below, is an improvement in a light fixture of the type having first and second housing members forming a housing around a lamp and relatively movable between closed-fixture and open-fixture positions for lamp-changing purposes.

In the inventive light fixture, a first reflector member is secured to the first housing member and includes a first connection-edge, and a separate second reflector member is separately secured to the second housing member and includes a second connection-edge abutting the first connection-edge when the housing members are in closed-fixture position. A lamp-opening is located between the first and the second connection-edges. When the housing members are in closed-fixture position, the reflector members together form a composite reflector. The second reflector member is preferably formed by a plurality of interconnected non-parallel contiguous surfaces.

The composite reflector is configured to envelope a light-emitting portion of the lamp to efficiently utilize the luminescence of the lamp to direct maximum light out through a lens. The first and the second reflector members are so configured and arranged within the housing that, when the housing is open by moving the second housing member, the reflector members separate to open complete barrier-free access to the lamp socket and the ballast wiring.

In preferred embodiments of the inventive light fixture, the lens is preferably affixed to the second housing member.

In highly preferred embodiments of this invention, the housing is formed by only the first and second housing members. It is further highly preferred that the composite reflector be formed by only the first and second reflector members.

In certain preferred embodiments, the inventive light fixture is a wall-mounted light fixture having first and second housing members forming a housing around a lamp. The first housing member includes a mounting surface abutting the wall, and the second housing member is movable with respect to the first housing member between closed-fixture and open-fixture positions for lamp-changing purposes. The first reflector member is secured to the first housing member. A separate second reflector member is separately secured to the second housing member such that, when the housing members are in closed-fixture position, the reflector members together form a composite reflector in the fixture housing, thereby facilitating lamp-replacement and fixture maintenance.

DETAILED DESCRIPTION OF PREFERRED EMBODIMENTS

Figure 1:
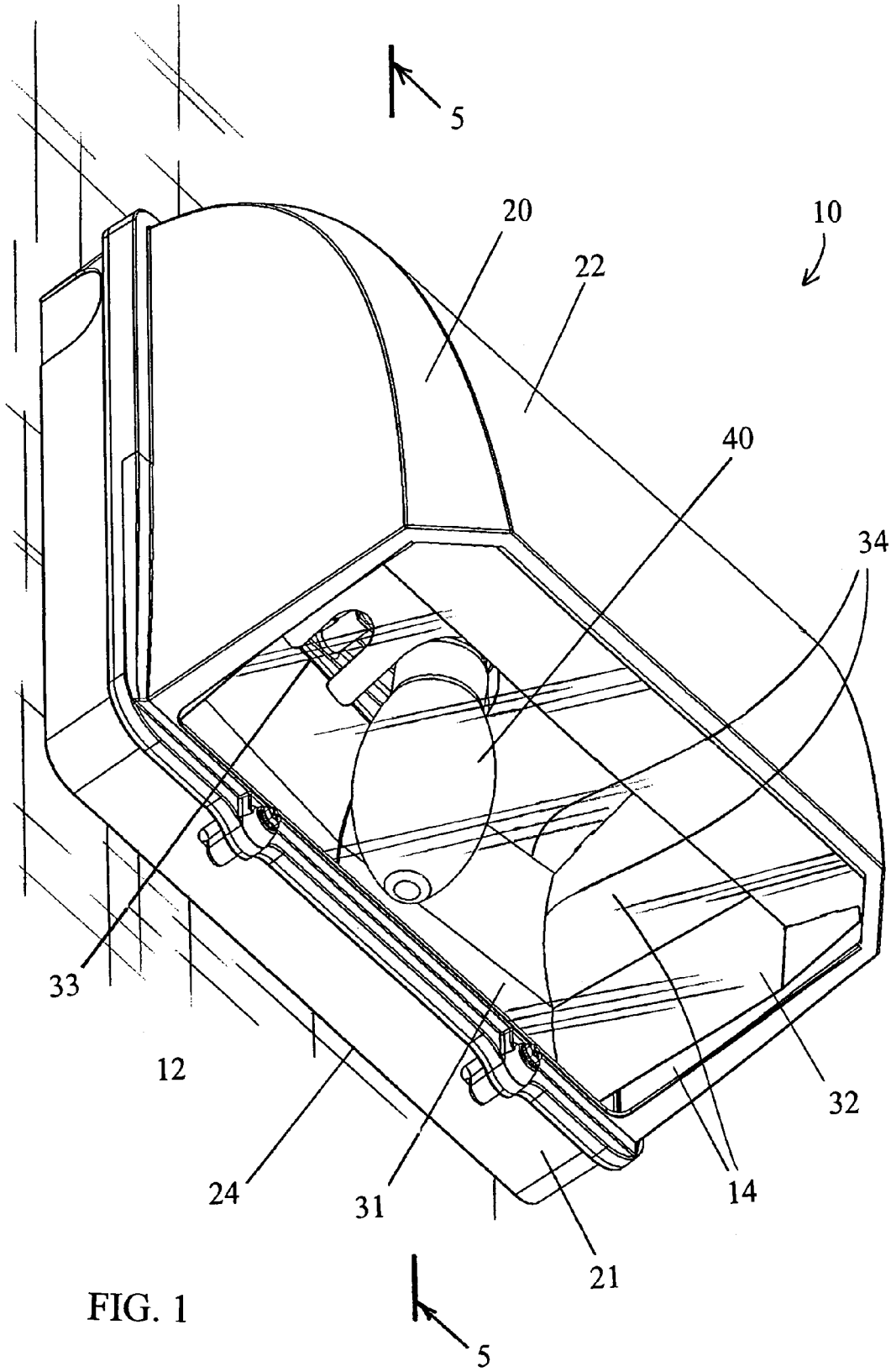
FIG. 1 is a perspective view from below of a wall-mounted light fixture in accordance with this invention, with the housing in the closed-fixture position.

FIGS. 1-5 illustrate preferred embodiment of the inventive wall-mounted light fixture 10 of the type having a first housing member 21 and a second housing member 22 forming a housing 20 around a lamp 40 and relatively movable between closed-fixture and open-fixture positions for lamp-changing purposes.

Figure 2:
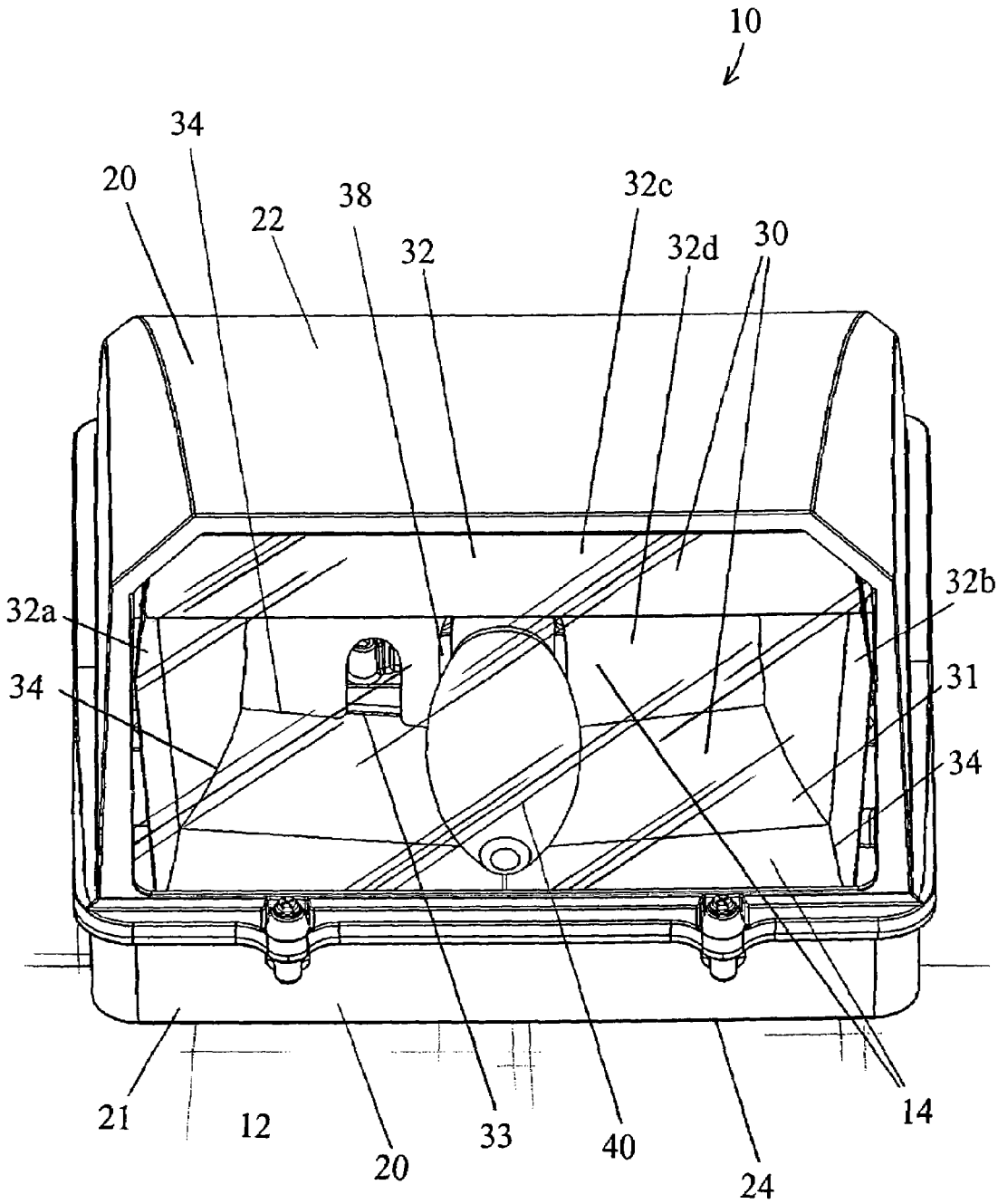
FIG. 2 is a cross-sectional view of the side-arm housing in closed position; bottom view of the fixture of FIG. 1.
Figure 3:
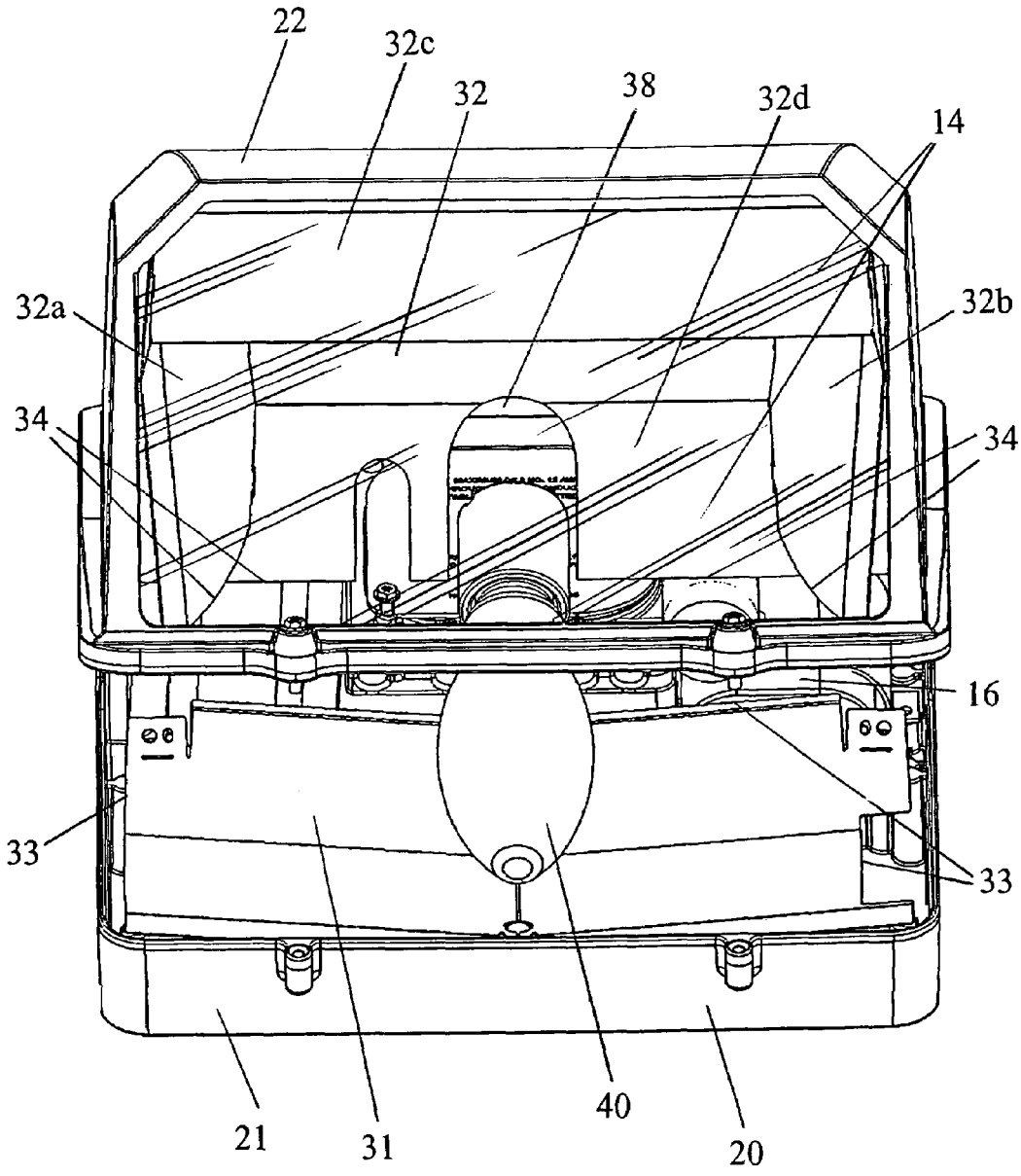
FIG. 3 is a perspective bottom view of the fixture as on a bench (prior to mounting), with the housing in the partially-open-fixture position.
Figure 4:
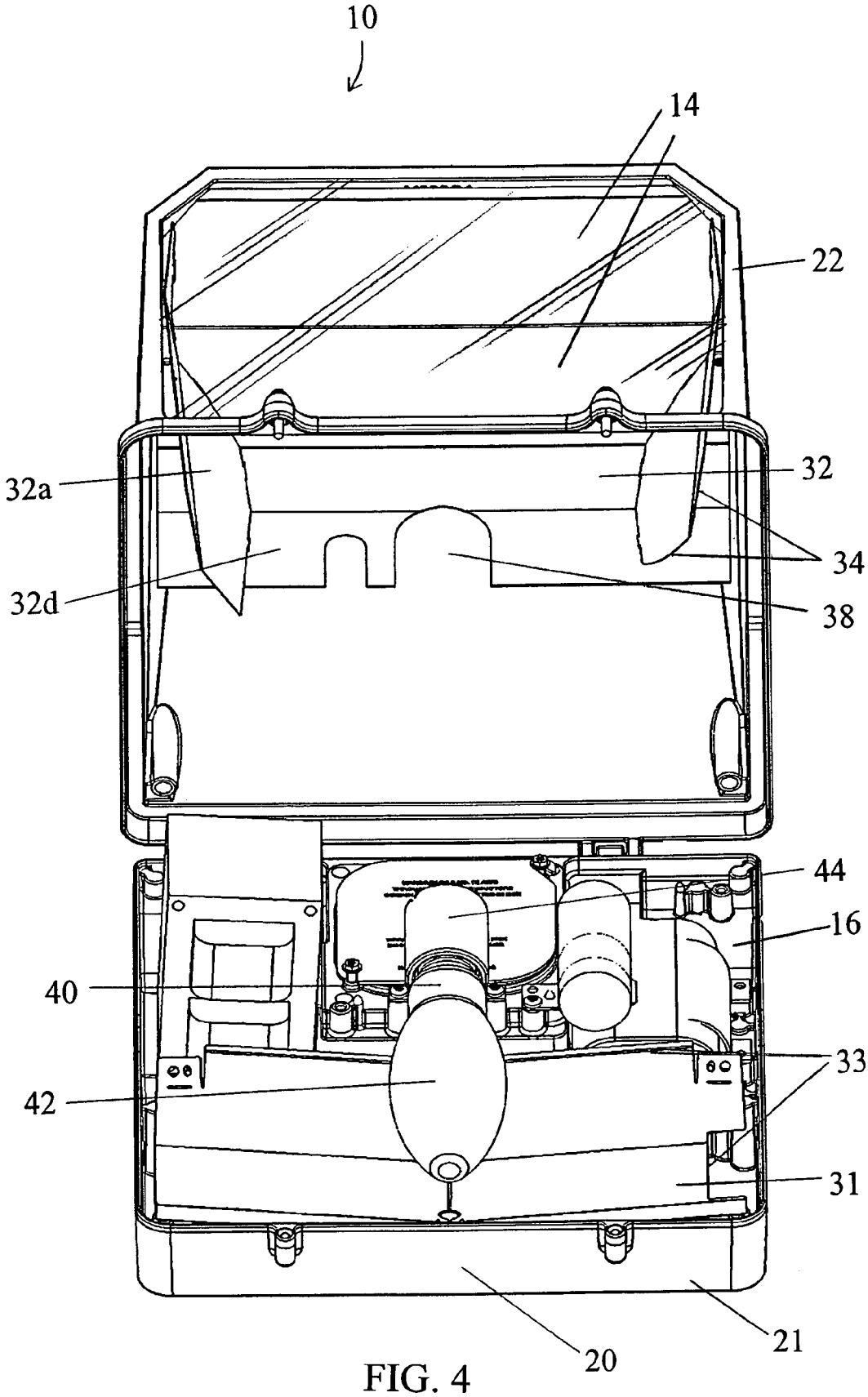
FIG. 4 is similar to FIG. 3, but with the housing in the fully-open-fixture position.
Figure 5:
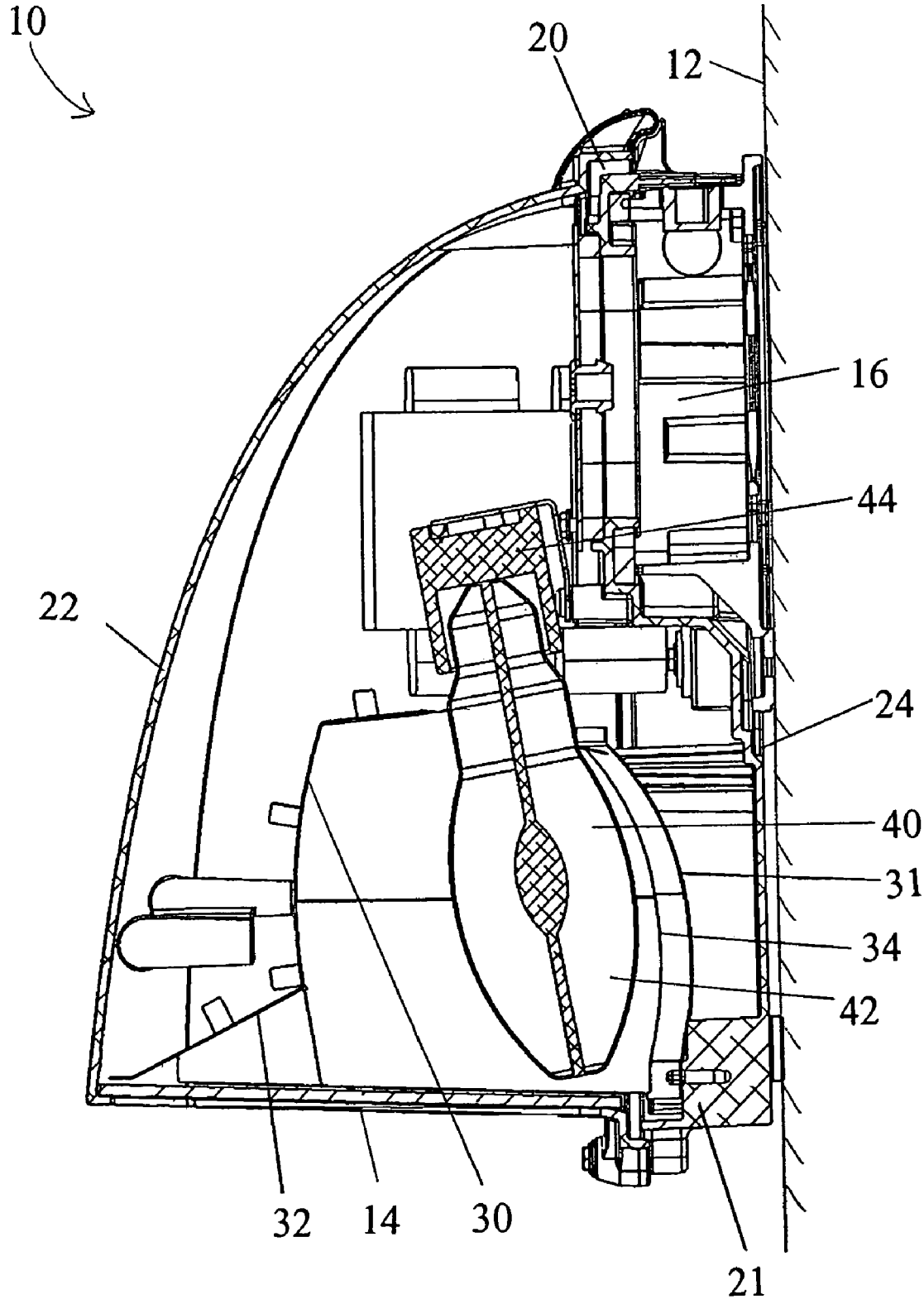
FIG. 5 is a right side sectional view of the fixture of FIG. 1, taken along section 5-5 as indicated in FIG. 1.
Figure 6:
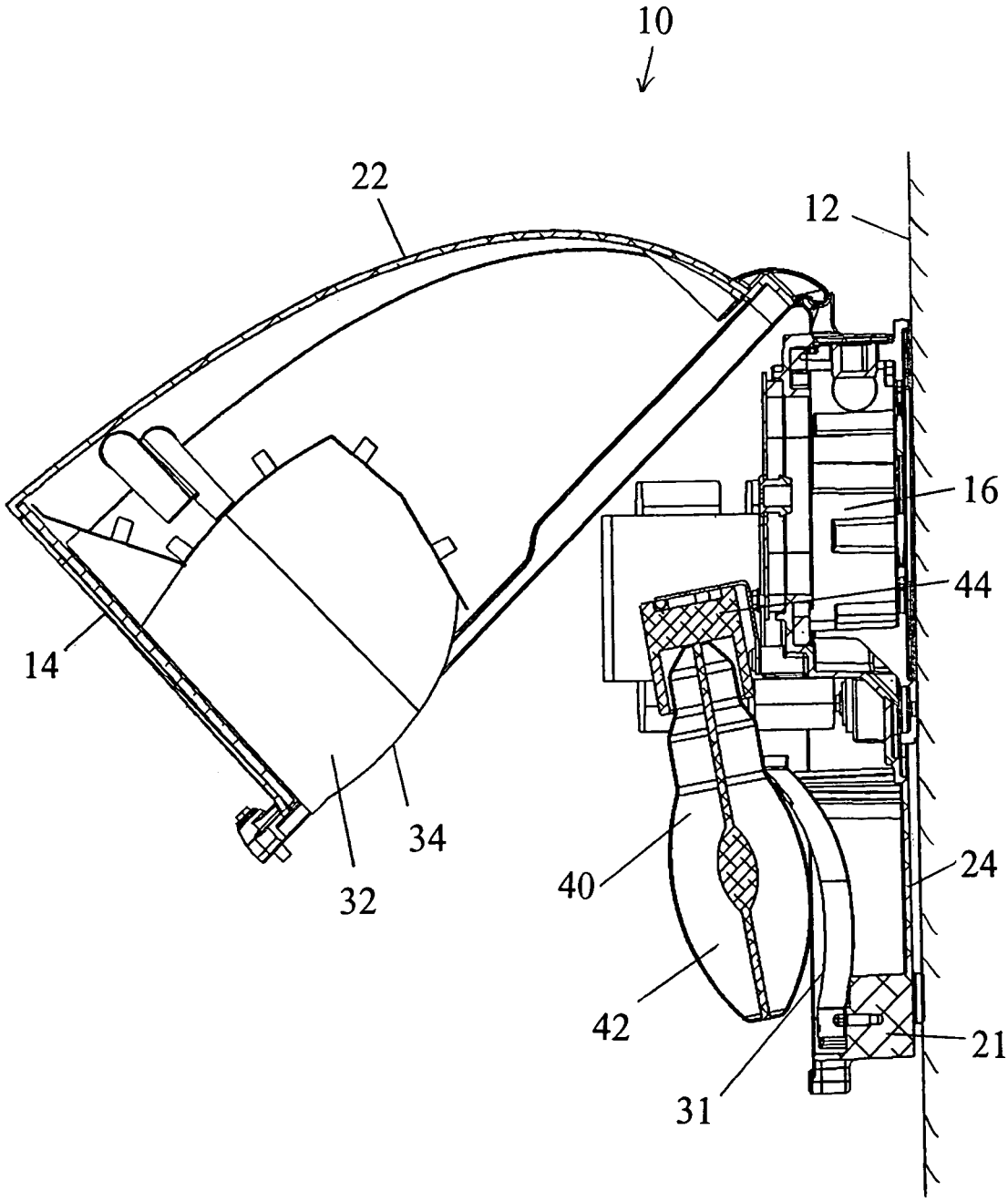
FIG. 6 is a similar right side sectional view, but with the housing in the open-fixture position.

As best seen in FIGS. 2, 3 and 5, a first reflector member 31 is secured to first housing member 21 and includes a first connection-edge 33, and a separate second reflector member 32 is separately secured to second housing member 22 and includes a second connection-edge 34 abutting first connection-edge 33 when housing members 21 and 22 are in closed-fixture position. When housing members 21 and 22 are in closed-fixture position, the reflector members 31 and 32 together form a composite reflector 30. A lamp-opening 38 is located between first connection edge 33 and second connection-edge 34. Second reflector member 32 is preferably formed by a plurality of interconnected non-parallel contiguous surfaces 32*a*, 32*b*, 32*c* and 32*d*.

As shown in the drawings illustrating preferred embodiment of the inventive light fixture 10, a lens 14 is preferably affixed to second housing member 22.

Housing 20 is preferably formed by only first and second housing members 21 and 22. It is further highly preferred that composite reflector 30 be formed by only first and second reflector members 31 and 32.

Composite reflector 30 is configured to envelope a light emitting portion 42 of lamp 40 to efficiently utilize the luminescence of lamp 40 directing maximum light out through lense 14. First and second reflector members 31 and 32 are so configured and arranged within housing 20 that, when housing 20 is open by moving second housing member 22, reflector members 31 and 32 separate to open complete barrier-free access to a ballast compartment 16 and a lamp socket 44.

The FIGS. 1-5 further show that in wall-mounted light fixture 10 first housing member 21 includes a mounting surface 24 abutting a wall 12.

While the principles of the invention have been shown and described in connection with specific embodiments, it is to be understood that such embodiments are by way of example and are not limiting.

The invention claimed is:

1. In a light fixture having first and second housing members forming a housing around a lamp and relatively movable between closed-fixture and open-fixture positions for lamp-changing purposes, the improvement comprising:

a first reflector member secured to the first housing member and including a first connection-edge;

a separate second reflector member separately secured to the second housing member and including a second connection-edge abutting the first connection-edge such that, when the housing members are in closed-fixture position, the reflector members together form a composite reflector; and a ballast compartment separated from the light-emitting portion of the lamp by the second reflector member of the composite reflector and containing a ballast and a lamp socket which accepts the lamp through a lamp-opening between the first and the second connection-edges, the reflector members being configured and arranged such that, when the second housing member is moved to its open-fixture position, the reflector members separate to give barrier-free access to the ballast compartment.

2. The light fixture of claim 1 wherein the second reflector member is formed by a plurality of interconnected non-parallel contiguous surfaces.

3. The light fixture of claim 1 wherein a lens is affixed to the second housing member.

4. The light fixture of claim 3 wherein the housing is formed by only the first and second housing members.

5. The light fixture of claim 4 wherein the composite reflector is formed by only the first and second reflector members.

6. In a wall-mounted light fixture having first and second housing members forming a housing around a lamp, the first housing member including a mounting surface abutting the wall, and the second housing member movable with respect to the first housing member between closed-fixture and open-fixture positions for lamp-changing purposes, the improvement comprising:

a first reflector member secured to the first housing member;

a separate second reflector member separately secured to the second housing member such that, when the housing members are in closed-fixture position, the reflector members together form a composite reflector in the fixture housing; and a ballast compartment separated from the light-emitting portion of the lamp by the second reflector member of the composite reflector and containing a ballast and a lamp socket which accepts the lamp through a lamp-opening in the second reflector member, the reflector members being configured and arranged such that, when the second housing member is moved to its open-fixture position, the reflector members separate to give barrier-free access to the ballast compartment, thereby facilitating lamp-replacement and fixture maintenance.

7. The wall-mounted light fixture of claim 6 wherein:

the first reflector member includes a first connection-edge; and the second reflector member includes a second connection-edge abutting the first connection-edge when the housing members are in closed-fixture position.

8. The wall-mounted light fixture of claim 7 wherein the composite reflector includes a lamp-opening between the first and the second connection-edges.

9. The wall-mounted light fixture of claim 7 wherein the second reflector member is formed by a plurality of interconnected non-parallel contiguous surfaces.

10. The wall-mounted light fixture of claim 6 wherein the composite reflector includes a lamp-opening between the first and the second connection-edges.

11. The wall-mounted light fixture of claim 6 wherein a lens is affixed to the second housing member.

12. The wall-mounted light fixture of claim 11 wherein the housing is formed by only the first and second housing members.

* * * * *